United States Patent [19]

Layman

[11] 4,067,757

[45] Jan. 10, 1978

[54] EDGING FOR SYNTHETIC TURF MATERIAL

[76] Inventor: Bruce W. Layman, 2000 Greenwood Road, McKinney, Tex. 75069

[21] Appl. No.: 734,409

[22] Filed: Oct. 21, 1976

[51] Int. Cl.[2] ..... A63B 67/00

[52] U.S. Cl. ..... 156/71; 156/216; 156/307; 428/17; 428/62; 273/55 R

[58] Field of Search ..... 428/17, 62; 273/3 R, 273/29 R, 55 R; 156/71, 307, 304, 216

[56] References Cited

U.S. PATENT DOCUMENTS

| | | | |
|---|---|---|---|
| 1,949,063 | 2/1934 | Merrill | 428/17 |
| 1,954,449 | 4/1934 | Klee | 273/3 R |
| 3,332,828 | 7/1967 | Faria et al. | 428/17 |
| 3,395,625 | 8/1968 | Blanchette et al. | 273/29 |
| 3,769,136 | 10/1973 | Ospelt | 156/307 |
| 3,816,199 | 6/1974 | Dawdy et al. | 156/71 |

*Primary Examiner*—Edward G. Whitby

*Attorney, Agent, or Firm*—Hubbard, Thurman, Turner, Tucker & Glaser

[57] ABSTRACT

The edges of a synthetic turf material are secured by forming a slot in the base structure that supports the synthetic turf material and thereafter inserting the edge of the turf material to be secured into the slot with an elongated retainer strip being inserted into the slot to secure the turf in place. The elongated retainer strip is sized to frictionally engage one side of the elongated slot and the synthetic turf edge to urge it into frictional contact with the other side of the elongated slot.

11 Claims, 2 Drawing Figures

EDGING FOR SYNTHETIC TURF MATERIAL

BACKGROUND OF THE INVENTION

This invention relates to a method for securing the edges of a synthetic turf material. In another aspect, this invention relates to an improved method for securing the edges of a synthetic turf material that has been applied over a rigid base material.

Recently, synthetic turf materials have been widely used to cover athletic fields, parade grounds, playgrounds, highway medians, areas surrounding swimming pools, patios, and the like. Such synthetic turf materials normally simulate a well-manicured, natural grass surface in that the synthetic turf material is made up of a multitude of upstanding ribbon-like fibers that are secured to a base or substrate. Such fibers as nylon, polypropylene, polyvinyl chloride and the like, have been widely used as the material for forming the upstanding grass leaf like ribbons. Because of the durability of such materials of construction, it is possible to produce a simulated grass surface, or a synthetic turf material that stands up well under extremely harsh conditions. Such durable surfaces are now widely used for the surfaces of athletic playing fields and the like, wherein the synthetic turf is exposed to a considerable amount of grinding, abrasive and twisting forces, caused by the shoes of athletes, animals, and the like, as they run or walk across the surface.

Many techniques have been developed in recent years for the installation of synthetic turf materials, especially in outdoor installations. Thus, improved seaming techniques for joining adjacent pieces of synthetic turf material together have reduced the number of failures experienced in large, synthetic turf installations. Improved techniques have also been developed for installing the synthetic turf materials over padding to produce a durable playing surface.

One very troublesome problem continues to plague the synthetic turf industry in that most synthetic turf installations utilize the synthetic turf material to cover the playing area but the peripheral edges of the playing area, such as around the sidelines of a football, or soccer, field, are not covered with the turf material. For example, many athletic fields will utilize a central area that is covered with synthetic turf material but a dirt or cinder running track or a warning strip extends around the peripheral edges of the field. In such instances, it is necessary to provide a method for securing the edges of the synthetic turf material in place. Several different methods for securing the edges of the synthetic turf material have been suggested in the past. Such methods include the burying of heavy, wooden beams in the ground, whereby the synthetic turf material can be tacked or glued to the wooden beams with the edges of the synthetic turf material being covered over with dirt and the like. Additionally, elaborate concrete beams have been buried in the ground with elaborate provisions made for wrapping the edges of the synthetic turf material over the sides of the concrete beam and securing the edges to the beam in some manner. There have even been suggestions of elaborate clip or clamp assemblies that seek to engage the edges of the synthetic turf material to hold them in place around the peripheral edge of the installation. All of these prior art methods for securing the edges of synthetic turf materials have suffered from various deficiencies. For example, such prior art methods are extremely difficult and costly to install. Additionally, it is very difficult to secure the synthetic turf materials with such prior art methods in a fashion whereby the peripheral edges of the playing field will stand up under normal use conditions.

It is, therefore, apparent that there is a need for an improved method for securing the edges of synthetic turf material. It is also apparent that there is a need for an improved method for securing the edges of a synthetic turf material in such a manner that it can be easily and quickly installed under field conditions and maintain its strength and integrity over long periods of use and exposure to the elements.

SUMMARY OF THE INVENTION

Accordingly, it is an object of this invention to provide an improved method for securing the edges of synthetic turf material. It is another object of this invention to provide an improved method for securing the edges of a synthetic turf material that has been applied over a rigid base structure. It is yet another object of this invention to provide an improved method for securing the edges of synthetic turf material in such a manner that the edges can be secured quickly and easily under field conditions and stand up under continued use in an outdoor environment.

Other aspects, objects and advantages of this invention will be apparent to those skilled in the art from the following description and appended claims.

In the instant invention, synthetic turf materials are installed in a system with the peripheral edges of the material secured to an underlying rigid base material. In securing the turf material according to this invention, an elongated slot is formed in the base material that supports the synthetic turf material. The edges of the synthetic turf material to be secured are inserted into the slot and an elongated retainer strip is thereafter inserted into the slot, which has the edge to be secured inserted therein. The elongated retainer strip is of a size and construction whereby it will bear against one of the side walls of the slot and force the edge of the synthetic turf material into frictional contact with the other side wall of the elongated slot, thereby holding the edge of the synthetic turf material securely in place.

DESCRIPTION OF PREFERRED EMBODIMENTS

Figure 1:
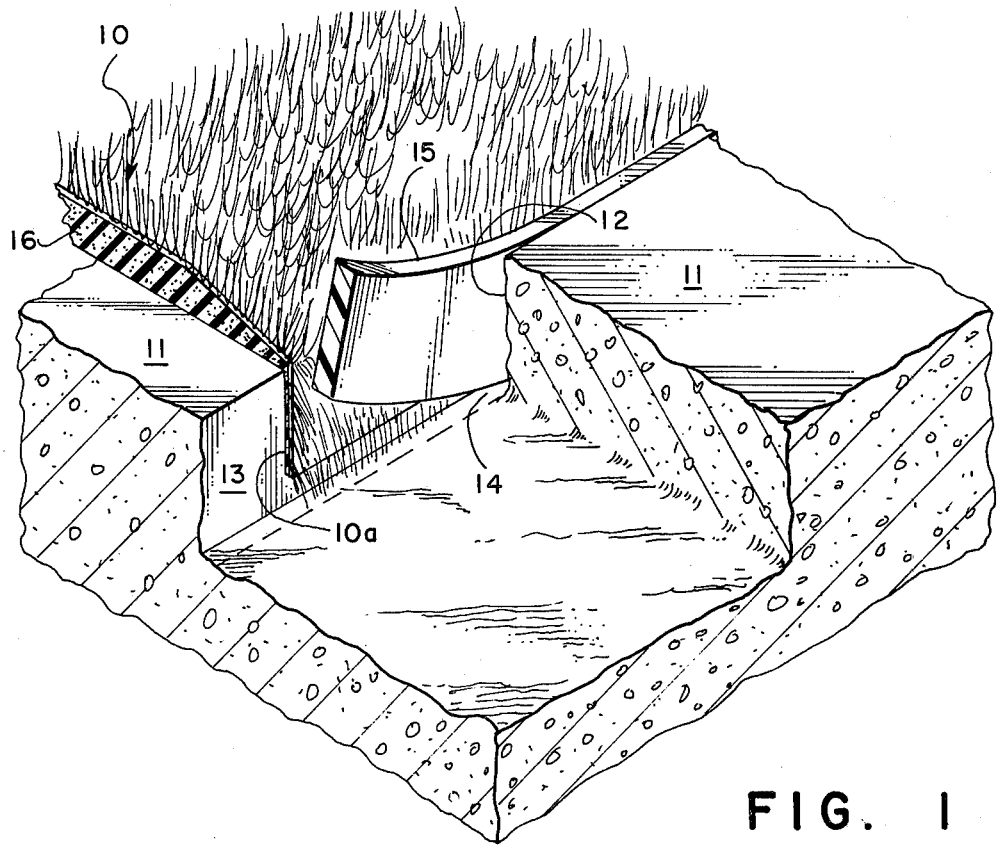
FIG. 1 is a perspective view of a piece of synthetic turf material as the edge of the turf material is being secured in accordance with the process of this invention.

The preferred embodiments of this invention can best be described by referring to the drawings. FIG. 1 is a perspective illustration of the installation of a synthetic turf system showing a portion of the underlying rigid base that supports the system being cut away. The cut away section of the underlying base material illustrates the elongated slot and the relative positioning of the various components of the edging system. As shown in FIG. 1, synthetic turf material 10 is in the form of a rather large sheet of material that extends across the area to be covered in a substantially horizontal manner. Various types of synthetic turf materials are well known in the art. Normally, the synthetic turf material will be installed over a pre-prepared base material 11. The pre-prepared base material 11 can be any suitable base material that will support the synthetic turf material under the use conditions to which the system will be exposed after installation. Several well known base materials have been widely used in the installation of synthetic turf systems. Particularly suitable base materials include asphalt base materials, asphaltic concrete base materials, concrete base materials, and the like. It is widely known in the installation of synthetic turf materials that the base material must first be prepared by leveling, or otherwise contouring, the support material and thereafter applying a layer of asphalt, asphaltic concrete, concrete, or the like, to form a rigid base material that will serve to support the entire system. Often, the base material of asphalt, asphaltic concrete or concrete is several inches thick to provide a strong, long lasting foundation for the installed system. As illustrated in the FIGURES, base material 11 is an asphaltic concrete material.

In carrying out the process of this invention, after the rigid base material has been installed, an elongated slot is formed in the base material to receive the peripheral edges of the synthetic turf material to be secured. The elongated slot can be formed by any suitable means such as by cutting the elongated slot in the rigid base material utilizing suitable saws or other cutting apparatus. Preferably, the elongated slot, to be formed in the rigid base material, will have substantially parallel sides. When conventional, artificial turf material is installed, utilizing the process of this invention, the width of the elongated slot should be sufficient to allow the edges of the synthetic turf material to be inserted downwardly into the slot by simply tucking the loose edge of the synthetic turf material downwardly into the slot. With conventional synthetic turf materials, the slot should have a width of at least about one-fourth inch to allow the turf material to be conveniently inserted into the slot. Following the insertion of the edge of the turf material into the slot, an elongated retainer strip is inserted into the slot and it is forced downwardly into place, thereby urging the synthetic turf material into contact with one of the walls of the elongated slot. The depth of the slot can be any convenient depth so long as it will receive the edge of the synthetic turf material to be secured. Under normal operations, it is preferred that the depth of the elongated slot be at least about two inches, whereby at least about one inch of the depth of the slot can be occupied by the edge of the synthetic turf material to be secured. It will, of course, be appreciated that the depth of the slot, as well as the amount of turf material inserted downwardly into the slot, can vary from one installation to another. However, in the installation of athletic fields, such as soccer fields, football fields and the like, it is preferred that the depth of the slot be at least about two inches and that the turf material be inserted downwardly into the slot to a depth of at least about one inch.

As shown in the FIGURES, an elongated slot is formed in base material 11 in such a manner that the elongated slot has a first wall 12 and a second wall 13. The walls of the slot are preferably parallel and transversely intersect slot bottom 14. Peripheral edge 10a of turf material 10 is inserted downwardly into the slot and elongated retainer strip 15 is pressed downwardly into the slot, whereby one face of retainer strip 15 will bear against first slot wall 12 to thereby force turf edge 10a into frictional engagement with second slot wall 13. By properly sizing elongated retainer strip 15, it can have a width that will essentially fill all of the space within the elongated slot to thereby ridigly and securely force turf edge 10a into contact with second slot wall 13. Preferably, elongated strip 15 will be of such size and dimensions whereby it must be forced downwardly into the slot by suitable pressing or hammering force to rigidly secure turf edge **10*a* in frictional contact with second slot wall 13. Therefore, in a preferred embodiment of this invention, the height of elongated strip 15 will coincide with the depth of the slot, whereby elongated strip 15 can be forced downwardly into the slot and come in contact with slot bottom 14 with the exposed top edge elongated strip 15 being flush with the upper surface of base material 11**.

It has been found to be particularly preferred to have elongated strip 15 to be fabricated from a relatively flexible but durable material, such as a thermoplastic material. Therefore, heavy extruded strips of thermoplastic material, such as polyvinyl chloride, polyethylene, nylon and the like, can be utilized to fabricate elongated strips 15. By using such heavy thermoplastic materials, it is possible to obtain the necessary rigidity to force the elongated strips downwardly into the slots to securely restrain turf edges 10a. Since the termoplastic materials do have some flexibility, they can be easily handled and installed into the slot system. The retainer strip can be fabricated from materials, such as wood, metal and the like.

Figure 2:
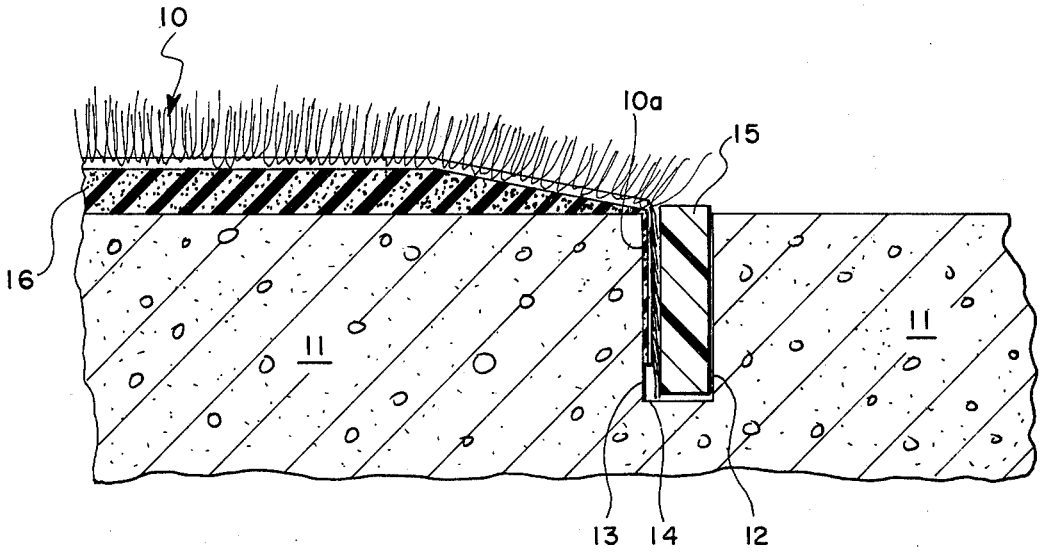
FIG. 2 is a cross-sectional view of a synthetic turf installation, showing the edge of the synthetic turf material secured by the process of this invention.

It will be appreciated that most installations of synthetic turf systems, especially for use in athletic fields, utilize a synthetic turf material 10 that is installed over a suitable pad or cushion material 16. Thus, when pad or cushion material 16 is installed under the synthetic turf material 10, it has been found preferable to bevel, or trim, the outward edges of pad or cushion material 16 toward the outer edge of the synthetic turf material. As more clearly shown in FIG. 2, cushion or pad 16 is relatively thick toward the center of the synthetic turf material installation, but it has been beveled, or trimmed, whereby the thickness decreases as the pad approaches the elongated slot. By such beveling or trimming, it has been found that the edge system, installed by the instant invention, has better wear capabilities and better appearance qualities.

It will be appreciated that while the foregoing description of the invention has been directed to elongated slots that have substantially parallel side walls, the side walls can have non-parallel sides whereby the walls tend to converge at the bottom of the slot. In such instances, it will be desirable to utilize an elongated retainer strip that will fit within the contour of the elongated slot. Additionally, it will be appreciated that the retainer strip may have a tapered appearance to facilitate installation of the retainer strip in the elongated slot. The tapered configuration of retainer strip 15 may make it easier to install the elongated retainer strip, especially when there is a very tight fit between the retainer strip and the walls of the elongated slot, having turf edge 10a inserted therein.

Since the instantly described invention has considerable utility in the installation of athletic fields, playgrounds and the like, it is usually desirable to utilize elongated retainer strips 15 that are colored to blend in with the synthetic turf color or the color of the surrounding, exposed base material 11. Therefore, the retainer strips 15 can be colored green, black, brown, or any other desired color to render them pleasing to the eye.

While the instantly described invention very adequately secures the edges of the synthetic turf in place by merely forcing retainer strip 15 downwardly into position to bear against the walls of the slot, it may be desirable in some instances to add a suitable adhesive or solvent material to further bond and secure the edges in place. Thus, it may be desirable to add an adhesive material to the slot either before or after turf edge 10a is inserted into the slot. Such an adhesive or solvent material can be chosen from any known materials that will adhere or bond turf edge **10*a* to second slot wall 13. Additionally, such adhesive or solvent materials can be utilized to bond retainer strip 15 to the walls of the slot and to the surface of turf edge 10*a***.

It has been found to be particularly preferred to install the system of this invention in such a manner that the elongated slot is formed in the base material followed by insertion of the edge of the turf material to be secured into the slot with the application of a solvent material that will at least partially dissolve, or soften, the material of construction of turf edge 10a and retainer strip 15 whereby a bond is formed between the material of construction of turf edge 10a and elongated retainer strip 15. Thus, when the synthetic turf material installed in accordance with this invention is essentially polyvinyl chloride, a polyvinyl chloride retainer strip 15 can be utilized in conjunction therewith and a solvent system containing a solvent that will soften or dissolve polyvinyl chloride can be added to the slot to literally fuse the synthetic turf material edge 10a to retainer strip 15 in the elongated slot, itself. Such a fusing or bonding together produces an extremely strong and durable edge around the periphery of the installed synthetic turf system. Of course, it will be appreciated that when a solvent or adhesive system is utilized to further secure the edges in place, the solvent should be a relatively volatile solvent that will evaporate to leave behind a thoroughly bonded edge, having few, if any, cracks or voids. Such a solvent system can be any volatile solvent system that will wet and dissolve the material of construction of turf edge 10a and retainer strip 15. The solvent should have sufficient volatility where it will evaporate from the locale of the secured edge within a reasonable period of time. Solvents that are overly volatile should be avoided because they are normally dangerous to handle and it is difficult to properly insert the necessary retainer strip 15 before the solvent evaporates. In some instances, it may be desirable to apply some external heat to the locale of the edge to assist in the evaporation of the volatile solvent, especially in cold, damp installations. One particularly preferred solvent system for use in forming secured edge systems of this invention, when the synthetic turf materials and the elongated retainer strips are made from polyvinyl chloride, is a solvent system that includes tetrahydrofuran. The tetrahydrofuran can be mixed with other cosolvents such as dimethylformamide. In some instances, it may be desirable to utilize other types of solvents in conjunction with the tetrahydrofuran or dimethylformamide. Methyl-ethyl-ketone can be utilized in conjunction with the tetrahydrofuran and dimethylformamide. In some instances, methyl-ethyl-pyrolodone can be substituted for the tetrahydrofuran.

It will be appreciated that the foregoing description of the process of this invention represents a distinct improvement in methods for securing edges of synthetic turf materials in place. Thus, the instant invention provides for a simple, but effective, technique for securing edges of synthetic turf materials under field conditions. The edges secured in place by this invention stand up extremely well over long periods of harsh use and require essentially no maintenance.

Various changes and modifications may be made in the foregoing description and disclosure without departing from the spirit and scope of this invention.

I claim:

1. A method of securing the edges of a synthetic turf material which comprises:

a. forming an elongated slot in a base supporting said turf material, said elongated slot having a first side wall and a second side wall;

b. inserting the edge of said turf material to be secured into said slot; and c. thereafter inserting an elongated retainer strip into said slot whereby one face of said retainer strip frictionally engages said first wall of said slot and the other face of said retainer strip bears against said synthetic turf material to urge it into frictional engagement with said second side wall of said slot.

2. The method of claim 1 wherein the said elongated slot is formed by cutting said base.

3. The method of claim 2 wherein said base is cut to form said elongated slot with said first side wall and said second wall being substantially parallel.

4. The process of claim 1 wherein an adhesive material for adhering said turf material to said base is injected into said slot before said elongated retainer strip is inserted.

5. The process of claim 1 wherein a volatile solvent material, capable of dissolving said elongated retainer strip and said synthetic turf material is injected into said slot before said retainer strip is inserted.

6. The process of claim 1 wherein said elongated retainer strip is a polymeric strip.

7. The process of claim 6 wherein said retainer strip is essentially a polyvinyl chloride material.

8. The process of claim 7 wherein a solvent material for polyvinyl chloride is injected into said slot before said retainer strip is inserted.

9. The process of claim 8 wherein said synthetic turf material is essentially a polyvinyl chloride material.

10. The process of claim 9 wherein said solvent comprises tetrahydrofuran.

11. The method of claim 1 wherein said elongated retainer strip is inserted into said slot to a depth whereby the upper end of said elongated retainer strip is flush with the surface of said base supporting said turf material.

* * * * *